United States Patent [19]

Randmer

[11] 3,947,797

[45] Mar. 30, 1976

[54] CIRCUIT INTERRUPTING MEANS

[75] Inventor: Jacob A. Randmer, Wilton, Conn.

[73] Assignee: The Machlett Laboratories, Inc., Stamford, Conn.

[22] Filed: June 7, 1974

[21] Appl. No.: 477,393

[52] U.S. Cl. ..... 337/31; 200/144 B; 337/32; 337/34

[51] Int. Cl.[2] ..... H01H 39/00

[58] Field of Search ..... 200/144 B; 317/60 A, 60 R, 317/61, 61.5, 62; 337/28, 30–34, 166, 405

[56] References Cited

UNITED STATES PATENTS

| | | | |
|---|---|---|---|
| 2,906,841 | 9/1959 | Jennings | 317/62 X |
| 3,411,038 | 11/1968 | Lee | 317/61.5 X |
| 3,514,559 | 5/1970 | Rahheim | 200/144 B |
| 3,546,407 | 12/1970 | Schneider | 200/144 B |
| 3,806,680 | 4/1974 | Link | 200/144 B |

*Primary Examiner*—Mark O. Budd
*Assistant Examiner*—Fred E. Bell
*Attorney, Agent, or Firm*—John T. Meaney; Joseph D. Pannone; Harold A. Murphy

[57] ABSTRACT

A circuit interrupting device comprising a vacuum fuse having an evacuated envelope wherein one or more fusible elements electrically connect spaced open ends of aligned tubular electrodes which have respective sealable ends external of the envelope and provide means for facilitating assembly and processing of the fuse.

8 Claims, 2 Drawing Figures

CIRCUIT INTERRUPTING MEANS

BACKGROUND OF THE INVENTION

This invention relates generally to current limiting means for protecting electrical apparatus and is concerned more particularly with a vacuum fuse for interrupting an electrical circuit in response to a current overload.

Components of an electrical circuit usually are protected from damage due to current overloads by a suitable type of circuit interrupting device, such as a vacuum fuse, for example. A vacuum fuse generally comprises an evacuated envelope having therein a fusible element electrically connected to a supporting pair of mutually spaced electrodes which are attached to respective external terminals of the fuse. The fusible element is provided with a much smaller cross-section than the support electrodes to ensure a rapid response when excessive current flows through the fuse.

In operation, the vacuum fuse may be series connected, for example, in an alternating current circuit such that the current flowing through the circuit passes through the fuse. Consequently, when the current exceeds a predetermined value, the fusible element melts and vaporizes thereby interrupting the circuit. The resulting gap between the support electrodes may be bridged by a current arc which is extinguished when the half cycle of the alternating current approaches zero value. During the next half cycle, the arc will not be re-ignited provided that a high dielectric is maintained in the gap between the support electrodes. Thus, after vaporization of the fusible element, it is required that the dielectric characteristics of the vacuum remain sufficiently high to prevent voltage breakdown across the gap between the support electrodes.

Accordingly, the effectiveness of a vacuum fuse depends not only on the response accuracy of the fusible element, but also on the dielectric strength of the vacuum within the envelope. Consequently, during processing, the component parts of the tube preferably are outgassed before assembly. Also, it is desirable that the component parts be baked out while the envelope is being evacuated in order to remove substantially all of the occluded gases before sealing the envelope. However, the relatively bulky support electrodes generally are more difficult to outgas than the other component parts of the fuse. Furthermore, the reduced cross-section of the fusible element presents handling problems during assembly and outgassing of the fuse.

Therefore, it is advantageous and desirable to provide a vacuum fuse with a simple and rugged structure which facilitates handling and outgassing of the component parts of the fuse during production thereof.

SUMMARY OF THE INVENTION

Accordingly, this invention provides a vacuum fuse comprising an evacuated envelope having therein one or more fusible elements electrically connecting spaced open ends of aligned tubular electrodes. The electrodes extend externally of the envelope and have respective outer end portions which are sealable when desired. Thus, the tubular electrodes provide means for assembling the entire fuse around a longitudinally extending rod which is slid out of the tubular electrodes prior to evacuation of the envelope, thereby facilitating the handling of parts during assembly of the fuse. The external end portion of one of the tubular electrodes then may be sealed off and the envelope evacuated through the external end portion of the other tubular electrode. During bake out, the tubular electrodes have both inner and outer surface areas from which occluded gases may evolve for evacuation from the envelope, thus facilitating the outgassing of the electrodes. When evacuation is completed, the external open end portion of the other electrode may be sealed off, thereby providing a high dielectric vacuum within the envelope.

A preferred embodiment of this invention comprises a cylindrical vacuum fuse having an evacuated tubular envelope wherein a plurality of fusible elements are electrically connected to mutually spaced, open ends of an axially aligned pair of tubular electrodes, thus providing a passageway which extends longitudinally through the envelope. The fusible elements are encircled by a spaced conductive shield which is electrically connected to an annular terminal insulatingly disposed in the envelope. The tubular electrodes extend longitudinally out of respective opposing ends of the envelope, each of the electrodes having a radial collar which is hermetically attached to a respective radial flange at the associated end of the envelope. External end portions of the respective electrodes are sealed off during processing of the fuse. The dielectric characteristics of the vacuum environment within the envelope may be tested by connecting a polarized voltage source between one of the electrodes and the annular terminal of the shield.

An alternative embodiment of this invention comprises a cylindrical vacuum fuse having an evacuated tubular envelope wherein first and second arrays of fusible elements are electrically connected to respective open ends of a centrally disposed tubular conductor and to respective adjacent open ends of axially spaced first and second tubular electrodes, thus providing a passageway which extends longitudinally through the envelope. The centrally disposed, tubular conductor is supported by a terminal disc which also supports a shield in spaced encircling relationship with the fusible elements. The first and second tubular electrodes extend longitudinally out of respective opposing ends of the envelope, each of the tubular electrodes having a radial collar hermetically attached to a respective radial flange at the associated end of the envelope. External end portions of the respective tubular electrodes are sealed off during processing of the fuse. An inner axial portion of one of the tubular electrodes is insulatingly encircled by an annular gas electrode having an outer peripheral portion external of the envelope. The dielectric characteristics of the vacuum environment within the fuse envelope may be tested by connecting a polarized voltage source between one of the tubular electrodes and the annular gas electrode.

BRIEF DESCRIPTION OF THE DRAWINGS

For a better understanding of this invention, reference is made in the following more detailed description to the accompanying drawing wherein.

DECRIPTION OF THE PREFERRED EMBODIMENT

Figure 1:
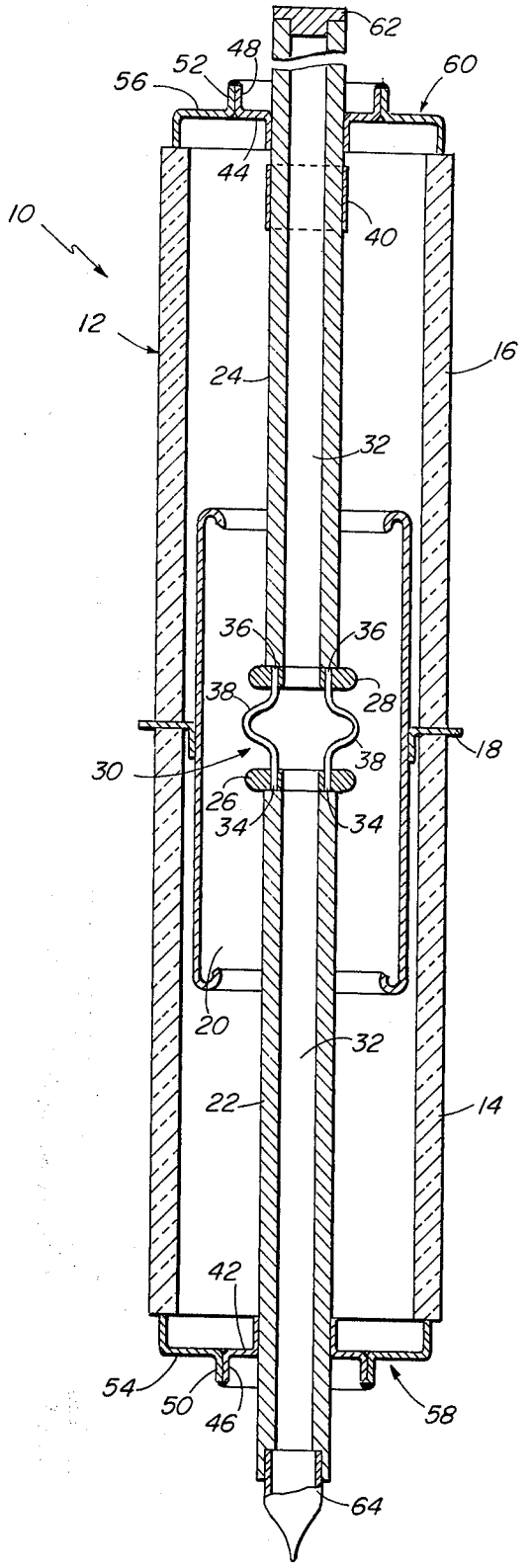
FIG. 1 is an axial sectional view of one embodiment of this invention.

Referring more particularly to the drawing wherein like characters of reference designate like parts, there is shown in FIG. 1 a cylindrical vacuum fuse 10 having an evacuated tubular envelope 12. Envelope 12 includes axially aligned hollow cylinders, 14 and 16 respectively, which may be made of dielectric material, such as ceramic, for example. The respective adjacent ends of cylinders 14 and 16 are sealed, in a well-known manner, to opposing surfaces of an annular disc 18 made of conductive material, such as Kovar, for example.

Disc 18 extends radially inwardly of envelope 12 and is supportingly attached, as by welding, for example, to a longitudinally extending tubular shield 20. The shield 20 preferably comprises a thin sleeve of conductive material, such as aluminum, for example, having opposing open ends provided with respective rounded edges. Shield 20 insulatingly encircles axially disposed end portions of aligned tubular electrodes, 22 and 24, respectively, which are made of rigid conductive material, such as copper, for example. The electrodes 22 and 24 extend substantially along the axial centerline of envelope 12 and project longitudinally out of respective opposing ends of the envelope.

Within envelope 12, the respective adjacent ends of electrodes 22 and 24 abut axially aligned, electrode face rings 26 and 28, respectively, and are attached thereto, as by brazing, for example. Electrode face rings 26 and 28 are made of suitable conductive material, such as zone refined copper, for example, and are spaced a predetermined distance from one another thereby forming a gap 30 therebetween. The electrode face rings 26 and 28 may extend radially outwardly of the attached electrodes 22 and 24, respectively, to facilitate arc quenching after burnout and to minimize the possibility of voltage breakdown across the gap 30. Preferably, the respective inner diameters of tubular electrodes 22–24 and electrode face rings 26–28 are approximately equal to one another so as to provide a generally uniform passageway 32 which extends longitudinally through the envelope 12.

Each of the electrode face rings 26 and 28, respectively, may have axially disposed in the annular body thereof an array of arcuately spaced apertures, 34 and 36 respectively. Preferably, the apertures 34 extend through the material of ring 26 and are substantially aligned with corresponding apertures 36 which extend through the material of ring 28. Axially disposed between the respective rings 26 and 28 may be a plurality of fusible elements 38 made of suitable conductive material, such as tungsten wire, for example. Each of the fusible elements 38 may have opposing end portions inserted into respective apertures 34 and 36, and be suitably secured, as by welding, for example, to the electrode face rings 26 and 28, respectively.

The fusible elements 38, preferably, have respective lengths greater than the distance between electrode face rings 26 and 28, in order to provide greater flexibility in compensating for unequal thermal expansion and contraction in the connecting component parts of fuse 10.

Although two fusible elements 38 have been shown for purposes of illustrating this invention, it is to be understood that any desired number of fusible elements may be disposed between the electrode face rings 26 and 28 respectively. Furthermore, the fusible elements 38 may be suitably connected to the electrode face rings 26 and 28, respectively, by means other than the described apertures 34 and 36, respectively.

A thin band 40 of getter material, such as silver palladium for example, may be suitably attached, as by welding, for example, to an outer surface of one of the tubular electrodes, such as 24, for example. Alternatively, a sleeve (not shown) of getter material may be slidably inserted into one of the tubular electrodes, 22 and 24, respectively.

Adjacent the opposing ends of envelope 12, respective radially extending collars 42 and 44 have inner peripheral portions hermetically attached, as by brazing, for example, to outer surfaces of the tubular electrodes, 22 and 24, respectively. The collars 42 and 44 are made of suitable thin conductive material, such as Kovar, for example, and have respective outer peripheral rims 46 and 48, respectively, which extend longitudinally outwardly of the envelope 12. The rims 46 and 48 are circumferentially sealed, as by welding, for example, to respective juxtaposed peripheral rims 50 and 52 of inwardly extending, annular flanges 54 and 56, respectively. The flanges 54 and 56 are made of suitable thin conductive material, such as Kovar, for example, and have outer peripheral portions sealed, in a well-known manner, to adjacent ends of the dielectric cylinders, 14 and 16, respectively.

Thus, in combination, annular flange 54 and radially extending collar 42 constitute a rugged lightweight end cap 58 at one end of envelope 12, through which the electrode 22 longitudinally extends. Also, in combination, annular flange 56 and radially extending collar 44 constitute a rugged lightweight end cap 60, at the other end of envelope 12 through which the electrode 24 longitudinally extends. The external end of tubular electrode 24 is hermetically sealed by any convenient means, as by welding a copper plug 62 therein, for example. The external end of tubular electrode 22 is vacuum sealed, in a well-known manner, to an exhaust tubulation 64 made of suitable material, such as copper, for example. The tubulation 64 is pinched-off, by conventional means, when evacuation of the envelope 12 is completed.

Accordingly, it may be seen that the tubular electrodes 22 and 24, respectively, provide means for readily assembling and processing the fuse 10. The fusible elements 38, respective electrode face rings 26–28, respective tubular electrodes 22–24, respective collars 42–44, and the exhaust tubulation 64, all may be assembled to one another, as described, while supported on an axially disposed fixture rod (not shown). The respective cylinders 14–16, annular disc 18, tubular shield 20, and respective flanges 54–56 all may be preassembled to one another, as described, and slid longitudinally over the subassembly prefabricated on the fixture rod. Then, the respective juxtaposed rims 46–50 and 48–52 may be heliarc welded. Subsequently, the fixture rod is withdrawn from the passageway 32, as by way of exhaust tubulation 64, for example; and the plug 62 may be welded into the external open end of electrode 24, as described. The exhaust tubulation 64 then provides means for mounting the assembled fuse 10 on a conventional exhaust machine (not shown) for evacuation of envelope 12.

The component parts of fuse 10 are preferably outgassed, in a conventional manner, prior to assembly. Also, it is desirable that the assembled parts be thoroughly baked-out, while mounted on the exhaust machine, to further remove occluded gases which then may be readily evacuated from the envelope 12. Generally, the electrodes supporting the fusible elements in vacuum fuses of the prior art are relatively bulky in comparison with other metallic component parts and, consequently, are usually more difficult to out-gas. However, in the described vacuum fuse 10, the tubular support electrodes 22 and 24 provide respective inner and outer cylindrical surface areas from which occluded gases may be evolved during bake-out and evacuated from envelope 12. In this manner, the required high dielectric characteristics of the vacuum environment within the fuse envelope may be readily achieved, and the exhaust tubulation 64 pinched-off, as described. Thus, it may be seen that the axially aligned, tubular support electrodes of this invention facilitate the handling and processing of the vacuum fuse 10.

The dielectric characteristics of the vacuum within the sealed envelope 12 may be tested by electrically connecting a polarized voltage source (not shown) between the external end of one of the tubular electrodes 22 and 24, respectively, and the annular disc 18. The polarized voltage source preferably is connected such that the fusible elements 38 are electrically positive with respect to the shield 20. Consequently, residual gas molecules within the fuse envelope may be ionized whereby positive gas ions will flow to the shield 20 and electrons will flow to the fusible elements 30. Also, an axially directed magnetic field may be employed for intensifying any resulting current flow. The current, thus produced, may be detected externally of envelope 12 by current indicating means, such as a suitable ammeter (not shown) connected in series with the voltage source, for example. Thus, the value of the measured current is indicative of the dielectric quality of the vacuum within the fuse envelope.

Figure 2:
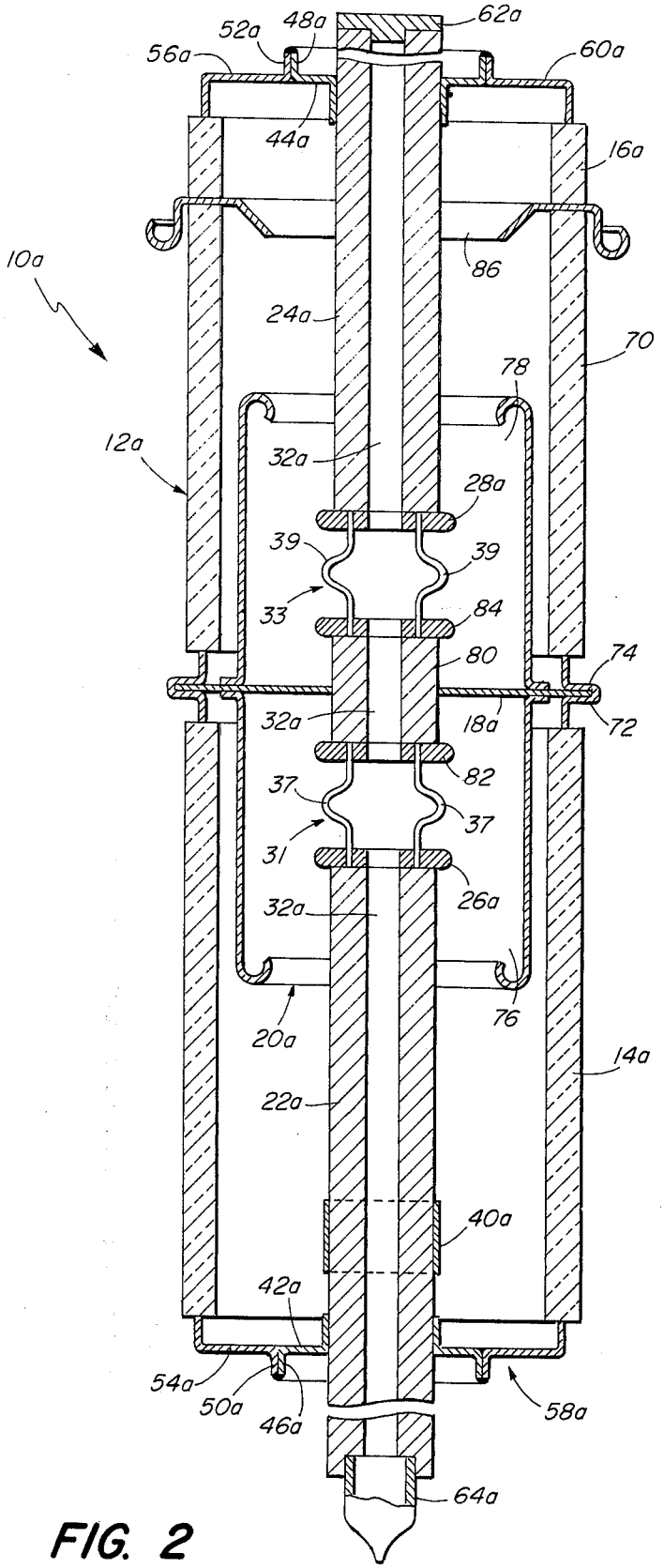
FIG. 2 is an axial sectional view of an alternative embodiment of this invention.

An alternative embodiment shown in FIG. 2 comprises a cylindrical vacuum fuse 10*a* having an evacuated tubular envelope 12*a*. Envelope 12*a* includes axially aligned, hollow cylinders 14*a*, 70, and 16*a*, respectively, which may be made of dielectric material, such as ceramic, for example. Cylinders 14*a* and 70 have respective adjacent ends peripherally sealed to outwardly extending, annular flanges 72 and 74, respectively, which may be made of suitable conductive material, such as Kovar, for example. The flanges 72 and 74 are hermetically attached to respective opposing flat surfaces of an annular disc 18*a* which extends radially within the envelope 12*a*. Adjacent the inner surfaces of cylinders 14*a* and 70, the disc 18*a* has attached to opposing flat surfaces thereof respective adjacent end portions of axially aligned sleeves 76 and 78 which are made of suitable rigid material, such as aluminum, for example. The sleeves 76 and 78, in combination, comprise a longitudinally extending shield 20*a*, and having opposing open ends which may be provided with respective rounded edges.

The inner periphery of disc 18*a* is supportingly attached to a centrally disposed, tubular conductor 80 which longitudinally extends substantially along the axial centerline of envelope 12*a*. Tubular conductor 80 is made of rigid conductive material, such as copper, for example, and has fixedly attached to opposing ends thereof respective axially aligned, electrode face rings 82 and 84. The electrode face rings 82 and 84 are made of suitable conductive material, such as zone refined copper, for example, and are spaced respective predetermined distances from axially aligned, electrode face rings 26*a* and 28*a*, respectively. Electrode face rings 26*a* and 28*a* are fixedly attached to axially aligned ends of tubular support electrodes 22*a* and 24*a*, respectively. The electrodes 22*a* and 24*a* extend substantially along the axial centerline of envelope 12*a* and project longitudinally out of respective opposing ends of the envelope.

Thus, there is provided between the electrode face rings 82 and 26*a* a respective gap 31, and between the electrode face rings 84 and 28*a* a respective gap 33. The gaps 31 and 33 provide a combined voltage drop which is capable of withstanding a higher breakdown voltage than the voltage drop provided by gap 30 shown in FIG. 1. Also, the electrodes face rings 82, 84, 26*a* and 28 may extend radially outward of the tubular supporting members in order to facilitate arc quenching after burnout and to minimize the possibility of voltage breakdown across the gaps 31 and 33. The respective inner diameters of tubular electrodes 22*a*, 24*a*, central tubular conductor 80, and electrode face rings 26*a*, 82, 84, 28*a*, preferably, are approximately equal to one another to provide a generally uniform passageway 32*a* which extends longitudinally through the envelope 12*a*.

Axially disposed between the annular bodies of electrode face rings 26*a* and 82, respectively, is a first plurality of fusible elements 37, each of which has opposing end portions electrically connected, as by welding, for example, to respective rings 26*a* and 82. Similarly, axially disposed between the annular bodies of electrode face rings 84 and 28*a*, respectively, is a second plurality of fusible elements 39, each of which has opposing end portions electrically connected, as by welding, for example, to the respective rings 84 and 28*a*. The fusible elements 37 and 39, respectively, are made of suitable conductive material, such as copper wire, for example, and preferably have respective lengths greater than the distances across the associated gaps 31 and 33, respectively.

Although only two gaps 31 and 33, respectively, have been shown, it will be appreciated that any desired number of electrode gaps may be disposed in series with one another between the opposing ends of the tubular envelope 12*a*. Also, each of the gaps may be spanned by any desired number of fusible elements having respective opposing end portions electrically connected to opposing electrode faces which define the gap.

A thin band 40*a* of getter material, such as silver palladium for example, may be suitably secured, as by welding, for example, to an outer surface of one of the tubular electrodes, such as 22*a*, for example. An axially extending portion of tubular electrode 24*a* may be insulatingly encircled by a spaced inner peripheral portion of a radially extending, gas electrode annulus 86. Annulus 86 is made of suitable conductive material, such as Kovar, for example, and has an outer peripheral portion sealed, in a well-known manner, between adjacent ends of cylinders 70 and 16*a* respectively. Cylinder 16*a* may be made of dielectric material, such as ceramic, for example, and has an opposing end sealed, in a well-known manner, to an outer peripheral portion of flange 56*a* which extends radially inwardly of the envelope 12*a*. Similarly, at the opposing end of tubular envelope 12*a*, the adjacent end of cylinder 14*a* is sealed, in a well-known manner, to an outer peripheral portion of a flange 54*a* which extends radially inwardly of the envelope.

The flanges 54*a* and 56*a* are made of suitable conductive material, such as Kovar, for example, and have respective inner peripheral rims 50*a* and 52*a* which extend longitudinally outwardly of the envelope 12*a*. The rims 50*a* and 52*a* are circumferentially sealed, as by welding, for example, to respective juxtaposed rims 46*a* and 48*a* of inwardly extending, annular collars 42*a* and 44*a*, respectively. The collars 42*a* and 44*a* are made of suitable conductive material, such as Kovar, for example, and have respective inner peripheral portions hermetically attached, as by brazing, for example, to axially extending portions of tubular electrodes, 22*a* and 24*a*, respectively. Thus, the combination of flange 54*a* and collar 42*a* constitute a rugged light-weight end cap 58*a* at one end of the envelope 12*a*, and the combination of flange 56*a* and collar 44*a* constitute a rugged light-weight end cap 60*a* at the opposing end of the envelope.

The external end of tubular electrode 24*a* may be hermetically sealed, in any convenient manner, as by welding a copper plug 62*a* therein, for example. The external end of tubular electrode 24*a* is vacuum-sealed, in a well-known manner, to an exhaust tubulation 64*a* which is made of suitable material, such as copper, for example. The tubulation 64*a* is pinched-off, by conventional means, when evacuation of the envelope is completed.

Accordingly, it may be seen that the tubular electrodes 22*a*, 24*a*, and the tubular center conductor 80 respectively, provide means for readily assembling and processing the fuse 10. The center conductor 80 having disc 18*a* preassembled thereto, respective electrode face rings 82, 84, 26*a*, 28*a*, respective arrays of fusible elements 37–39, respective tubular electrodes 22*a*–24*a*, respective collars 42*a*–44*a*, and the exhaust tubulation 64*a*, all may be assembled to one another, as described, while supported on an axially disposed fixture rod (not shown). The sleeve portions 76 and 78 of shield 18*a* then may be suitably attached to opposing flat surfaces of the disc 18*a*. Cylinder 14*a* having the flange 54*a* preassembled thereto may be passed longitudinally over one end of the components assembled on the fixture rod until the flange 72 abuts the adjacent surface of disc 18*a*. The cylinder 70, gas electrode annulus 86, cylinder 16*a*, and the flange 56*a* may be preassembled and passed longitudinally over the other end of the components assembled on the fixture rod until the flange 74 abuts the adjacent surface of disc 18*a*.

Then, the flanges 72 and 74 may be hermetically attached to disc 18*a*, as by heliarc welding, for example. Similarly, the juxtaposed rims 46*a*–50*a*, and 48*a*–52*a* may be hermetically attached to one another to form end caps 58*a* and 60*a* respectively. Finally, the fixture rod may be withdrawn from the longitudinally extending passageway 32*a*, as by way of the exhaust tubulation 64*a*, for example; and the plug 56*a* then may be welded into the external open end of electrode 24*a*. The exhaust tubulation 64*a* then provides means for mounting the assembled fuse 10*a* on a conventional exhaust machine (not shown) for evacuation of the envelope 12*a*.

The tubular electrodes 22*a*, 24*a* and the tubular center conductor 80 provide respective inner and outer cylindrical surfaces whereby occluded gases may be evolved from the materials thereof during bake-out and evacuation. Consequently, the required high dielectric characteristics of the vacuum environment within the fuse envelope 12*a* may be readily achieved and the exhaust tubulation 64*a* pinched off. Thus, it may be seen that the axially aligned, tubular electrodes 22*a*, 24*a* and center conductor 80 provide an axially extending passageway 32*a* which facilitates handling and processing of the vacuum fuse 10*a*.

The dielectric characteristics of the vacuum within the sealed envelope 12*a* may be tested by electrically connecting a polarized voltage source (not shown) between the external end of tubular electrode 24*a* and the outer peripheral portion of the gas electrode annulus 86. Preferably, the polarized voltage source is connected such that the tubular electrode 24*a* and the connected components of the fuse 10*a* are positive with respect to the gas electrode annulus 86. As a result, positive ions of any residual gas molecules within the envelope 12*a* will be drawn to the gas electrode annulus 86, and the electrons will flow to the axially disposed electrode 24*a*. Also, an axially directed magnetic field (not shown) may be employed for intensifying the resulting current flow. Any current, thus produced, may be detected externally of the envelope by a suitable ammeter connected in series with the source. The value of the current, thus measured, is indicative of the dielectric quality of the vacuum within the envelope of fuse 10*a*.

From the foregoing, it will be apparent that all of the objectives of this invention have been achieved by the structures shown and described herein. It also will be apparent, however, that various changes may be made by those skilled in the art without departing from the spirit of the invention as expressed in the appended claims. It is to be understood, therefore, all matter shown and described herein is to be interpreted as illustrative and not in a limiting sense.

I claim:

1. A circuit interrupting device comprising:

an evacuated envelope;

tubular conductive means including a pair of tubular electrodes having spaced inner end portions open to one another within the envelope and sealable outer end portions external of the envelope for providing a passageway through the envelope; and conductive fusible means disposed within the envelope for electrically connecting the spaced inner end portions of the tubular electrodes to one another.

2. A circuit interrupting device as set forth in claim 1 wherein the spaced inner end portions of the tubular electrodes are disposed in opposing relationship, and the fusible means comprises a plurality of fusible elements connected therebetween.

3. A circuit interrupting device as set forth in claim 1 wherein the tubular conductive means includes at least one tubular conductor disposed within the envelope and having opposing open ends aligned with respective spaced inner ends of the pair of tubular electrodes.

4. A circuit interrupting device as set forth in claim 3 wherein the fusible means comprises first and second arrays of fusible elements, each array being connected to a respective end of the tubular conductor and the adjacent inner end portion of one of the tubular electrodes.

5. A circuit interrupting device comprising:

an evacuated tubular envelope;

a pair of axially aligned tubular electrodes having respective open ends within the envelope disposed in spaced opposing relationship with one another and respective sealable open ends external of the envelope; and current responsive fusible means within the envelope electrically connected to the spaced electrode ends therein.

6. A circuit interrupting device as set forth in claim 5 wherein the electrode open ends within the envelope have respective outwardly extended annular flanges attached thereto.

7. A circuit interrupting device as set forth in claim 6 wherein the fusible means comprises an array of spaced fusible elements axially disposed between the respective annular bodies of the flanges, each of the fusible elements having opposing end portions attached to the respective flanges.

8. A circuit interrupting device as set forth in claim 7 wherein the fusible elements have respective lengths greater than the distance between the spaced electrode ends.

* * * * *